US009723885B2

(12) United States Patent
Shoraka

(10) Patent No.: US 9,723,885 B2
(45) Date of Patent: Aug. 8, 2017

(54) TROUSERS-SUPPORTING WAIST BELT

(71) Applicant: Karim Shoraka, Houston, TX (US)

(72) Inventor: Karim Shoraka, Houston, TX (US)

( * ) Notice: Subject to any disclaimer, the term of this patent is extended or adjusted under 35 U.S.C. 154(b) by 43 days.

(21) Appl. No.: 14/664,019

(22) Filed: Mar. 20, 2015

(65) Prior Publication Data

US 2015/0272247 A1 Oct. 1, 2015

Related U.S. Application Data

(60) Provisional application No. 61/969,883, filed on Mar. 25, 2014.

(51) Int. Cl.
*A41F 9/02* (2006.01)
*A41C 1/08* (2006.01)

(52) U.S. Cl.
CPC . *A41F 9/02* (2013.01); *A41C 1/08* (2013.01)

(58) Field of Classification Search
CPC .... A41C 3/08; A41C 1/02; A41C 1/06; A41C 1/10; A41C 3/00; A41C 3/0014; A41C 3/0021; A41C 3/0028; A41C 3/0057; A41C 3/0092; A41C 3/02; A41C 3/06; A41C 5/00; A41D 15/00; A41D 1/04; A41D 1/205; A41D 1/22
USPC ..... 2/107, 69, 106, 221, 400, 102, 328, 326, 2/327
See application file for complete search history.

(56) References Cited

U.S. PATENT DOCUMENTS 820,856 A * 5/1906 Ettinger ..... A41F 5/00 2/107
1,292,719 A * 1/1919 Davis ..... A41F 19/00 2/337
1,331,557 A * 2/1920 Brierly ..... A41F 9/00 2/107
2,134,600 A * 10/1938 Calnan ..... A41F 9/002 2/320
2,619,651 A * 12/1952 Leonard ..... 2/320
2,896,220 A * 7/1959 Kenny ..... A41F 9/002 2/308
3,127,896 A * 4/1964 Puliafico ..... A41D 1/06 2/227
3,280,405 A * 10/1966 Fruhwirth ..... A41F 5/00 2/107
5,867,836 A * 2/1999 Quinones ..... A41F 9/02 2/221
6,308,338 B1 * 10/2001 Caldwell ..... A41D 1/062 2/312
7,921,474 B2 * 4/2011 Miller ..... A41F 9/002 2/338
8,074,298 B2 * 12/2011 Davenport ..... A41B 9/001 2/227

(Continued)

*Primary Examiner* — Anna Kinsaul
*Assistant Examiner* — Catherine M Ferreira
(74) *Attorney, Agent, or Firm* — Egbert Law Offices, PLLC

(57) ABSTRACT

An apparatus for supporting trousers has an elastic band adapted to wrap around a waist of a person wearing the trousers, a pouch affixed at or adjacent to a lower edge of the elastic band, and a trousers-engaging element for grasping or abutting an interior surface of the trousers. The trousers-engaging element is a strip of polymeric material received within the interior of the pouch. The strip a polymeric material has a vertical portion and a horizontal portion. The horizontal portion is adapted to engage with an interior surface of the trousers.

11 Claims, 3 Drawing Sheets

(56) References Cited

U.S. PATENT DOCUMENTS

| | | | | |
|---|---|---|---|---|
| 8,601,615 | B2 * | 12/2013 | Isaacson | A41F 17/00 2/117 |
| 9,119,426 | B1 * | 9/2015 | Skanron | A41D 1/20 |
| 2007/0033708 | A1 * | 2/2007 | Mars | A41F 9/007 2/237 |
| 2008/0172769 | A1 * | 7/2008 | Herget | A41F 9/02 2/76 |
| 2010/0037371 | A1 * | 2/2010 | Lewis | A41F 9/002 2/340 |
| 2012/0052770 | A1 * | 3/2012 | Bhojwani | A41D 1/06 450/95 |

* cited by examiner

TROUSERS-SUPPORTING WAIST BELT

CROSS-REFERENCE TO RELATED APPLICATIONS

The present application claims priority from U.S. Provisional Patent Application Ser. No. 61/969,883, filed on Mar. 25, 2014, and entitled "Trousers Supporting Waist Belt".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to girdles. More particular, the present invention relates to devices for supporting the trousers at the waistline of a wearer. Additionally, the present invention relates to girdle/trouser-supporting structures which are used to both compress the abdomen while, the same time, maintaining the trousers at a desired position at the waist of the wearer.

2. Description of Related Art Including Information Disclosed Under 37 CFR 1.97 and 37 CFR 1.98

Lower garments, such as trousers, are traditionally held up by the use of belts or suspenders. Belts typically insert into belt loops to hold the trousers around the waist. The success of the belt depends on whether the wearer has a flat stomach. If the stomach is not flat, the extra weight from the stomach pushes the trousers down causing an unattractive drooping look. A trouser wearer will often begin wearing suspenders which attach to the lower garment and then over the upper garment using shoulder straps which adjust to keep the lower garment from dropping. For active and casual clothing wearers, the use of suspenders is not practical. One style of casual clothing is to wear the upper garment so that the bottom of the garment is worn over the lower garment, i.e. not tucked into the lower garment. Suspenders then have to be worn under the upper garment. This creates an inconvenience such that the wearer that has to take off his shirt when he needs to use a restroom for accessing the lower garment. Suspenders are considered "older persons" clothing and just do not match aesthetically when the upper garment is a Hawaiian shirt, a golf shirt, or a T-shirt. Additionally, such suspenders are not attractive when sweaters are worn over the trousers. Additionally, this type of clothing is often not used for sports and other leisure activities, since the wearing of suspenders hinders body movement and agility.

Studies show that most Americans are overweight. For many overweight Americans, the excess weight is visible because for a flabby stomach. Suspenders and belts do nothing to enhance the appearance of the wearer's stomach when the stomach extends over the lower garment. This frustrates the wearer's expectation of a healthy slim look.

The prior art for lower garment supports are belts and suspenders. The belt, when properly tightened, works well for many body shapes, but in the case of many other shapes of bodies, the lower garment slips down while going through the normal day's activities. Belts are worn normally to hold up the lower garment such as, for example, jeans, shorts, skirts and pants. The belt is inserted through a plurality of belt loops and works by exerting pressure on the waistband of the clothing as it presses against the body to achieve its ability to support the lower garment. The garment that is tucked in during normal daily activities will pull out of the lower garment. This is due to gravity. Gravity causes the lower garment to slip down from the original position at the waist. The person has to pull the clothing back up and re-tuck the upper garment back into the lower garment that has slipped down. During physical activities, the reoccurrence of the pull-up of the lower garment and the tucking of the upper garment happens more often. Typically, throughout the day, persons will repeatedly pull up the lower garment and re-tuck the upper garment.

In the past, various patents and patent publications have issued relating to trousers supports and girdle-type apparatus. As for example, U.S. Pat. No. 3,127,896, issued on Apr. 7, 1964, describes a slacks and girdle combination that includes an inner girdle body and an outer slacks body each provided with a waistband and each provided with a side opening downwardly from the waistband. Complementary slide fasteners are carried by the sides. The slide fastener elements are carried by the girdle waistband longitudinally for engagement with the slacks.

U.S. Pat. No. 6,308,338, issued on Oct. 30, 2001 to A. H. Caldwell, discloses trouser suspenders for securing trousers at a predetermined position below the waist. The trouser suspenders have a waist strap designed to extend around the waist of a wearer. A first extender is attached to, and dependent from, the waist strap and the first extender has one fastener attached directly thereto. A second extender is attached to, and dependent from, the waist strap and the second extender has one fastener attached directly thereto. The fastener of the first extender and the fastener of the second extender are attached to the trousers.

U.S. Pat. No. 7,921,474, issued on Apr. 12, 2011 to E. A. Miller, discloses an inside belt that fits along the juncture of a person's stomach and thighs. The inner belt has first and second arches with a garment supported by the arch and the arch sized to offset the garment's waistline from the inner belt. Each arch has a front end and a rear end fastened to the inner belt. The front end of each arch is located so it fastens to the inner belt adjacent the user's crotch during use. The rear end of each arch is located so it fastens to the inner belt. A first loop extends from each arch, over the waistline, and a normal outer belt threads through the first loop and also through the normal belt loops on the garment. The outer belt supports the garment and the first loop and arches support the outer belt in a position offset from the inner belt.

U.S. Pat. No. 8,074,298, issued on Dec. 13, 2011 to I. Davenport, discloses a pants construction that includes an undergarment having a drawstring, an elastic band, or other securing mechanism on the waistband. The undergarment is attached to the inside of a pair of pants or shorts with a hook-and-loop type fastener, buttons, zippers, snaps, tie strings, temporary glue or the like. The attachment is concealed and is arranged such that at least some of the upper portion of the undergarment is revealed above substantially the entire circumference of the waistband of the pants. The waistband of the pants is below the waist of the wearer. A securing mechanism associated with the undergarment stabilizes the pants to prevent them from falling down.

U.S. Patent Publication No. 2010/0037371, published on Feb. 18, 2010 to G. F. Lewis, teaches a method and apparatus for securing a lower garment over a garment wearer's stomach to keep the lower garment from drooping without the need to secure the lower garment to an upper garment and without the need for a separate waist belt. An elastic belt with a hook-and-loop fastener is connected to suspender clips which are attached to the lower garment before the garment is worn. When the lower garment is worn, the garment is pulled up with the belt suspenders and secured over the stomach. When the wearer is comfortable, the hook-and-loop fastener is pressed together. The apparatus is designed to be worn under an upper garment that is not tucked into the lower garment.

U.S. Patent Publication No. 2012/0052770, published on Mar. 1, 2012 to R. Bhojwani, describes a zip-in pant girdle worn by a user in combination with a pair of pants with an inside waistband to secure the pants to prevent the pants from sliding down and falling down. The girdle includes a base cloth band that is worn above the pants, a first upper portion that includes a distal end that is disposed on the bottom perimeter of the base cloth band and a second zipper portion that includes a distal end that is disposed within the inside waistband of the pants and corresponds with the first upper portion to form a zipper that removably secures the base cloth to the pants.

U.S. Pat. No. 8,601,615, issued on Dec. 10, 2013 to Isaacson et al., provides a shirt hold down undergarment. The undergarment includes a body and a first elongated loop attached to a front side of the body and configured to receive an attachment mechanism of a shirt hold-down device. The undergarment further includes a second elongated loop attached to a backside of the body and configured to receive an attachment mechanism of a shirt hold-down device.

U.S. Patent Publication No. 2007/0033708, published on Feb. 15, 2007 to J. R. Mars, discloses strapless belt suspenders and a method of supporting the belt to support the lower garment and improve the appearance of the upper garment. In particular, the method and apparatus serves for to conjoin of the upper and lower garments to achieve additional support for the lower garment without the need for suspender straps. An adhesive rubber pad is attached to a durable waistband bracket that supports the belt which directly supports the belt loops which are attached to the waistband. Multiple strapless belt suspenders contribute to the support of the weight of the lower garment.

U.S. Patent Publication No. 2008/0172769, published on Jul. 24, 2008 to J. N. Herget, discloses a separate, transferable, attachable and removable stretch waistband device that is used to convert the use of a regular lower garment article into early stages up to full-term maternity use and for accommodation of any increase or decrease in waistline size. The expandable waistband is worn at the waist or hip region of the wearer and conforms to the changing shape of the wearer. The stretchable band temporarily attaches to the belt loops of an existing lower garment article that is transferable from one lower garment to another. Belt loop attachment mechanism stops consisting of fasteners are used to attach the waistband to the belt loops of an existing lower garment.

It is an object of the present invention to provide a trousers supporting waist belt that effectively compresses the abdomen of the user so as to provide an attractive appearance.

It is another object of the present invention to provide a trousers supporting waist belt which effectively supports the trousers without the need for suspenders and/or belts.

It is another object of the present invention to provide a trousers supporting waist belt that is entirely concealed beneath the clothing of the wearer.

It is a further object of the present invention to provide a trousers supporting waist belt that conforms to various sizes and shapes of wearers.

It is still another object of the present invention to provide a trousers supporting waist belt that serves to maintain a pleasing tucked-in appearance between the upper garment and the lower garment.

It is still a further object of the present invention to provide a trousers supporting waist belt that is easy to apply and comfortable when in use.

These and other objects and advantages of the present invention will become apparent from a reading of the attached specification and appended claims.

BRIEF SUMMARY OF THE INVENTION

The present invention is a trousers supporting waist belt that includes an elastic band, a pouch affixed to a lower end of the elastic band, and a trousers-engaging means for grasping or abutting an interior surface of the trousers. The trouser-engaging means is received within the pouch so as to extend around the waist of the wearer.

The elastic band is suitable for extending around a waist of the wearer. In particular, this elastic band can be applied around the abdomen of the wearer. It is desirable the elastic band acts so as to compress the abdomen of the wearer, in the nature of a girdle. The elastic band is of a generally circular or oval configuration. The elastic band is flexible and adaptable to various sizes of users. The elastic band can include suitable fasteners such that the elastic band can be wrapped around the waist of the wearer or can the easily unfastened for removal from the waist of the wearer. These fasteners can be in the nature of hook-and-loop material, buttons, zippers, snaps, and other techniques. In other circumstances, the elastic band can be entirely integral so that it can be pulled up over the legs and lower torso of the wearer so as to be positioned around the waist.

The pouch is affixed to a lower end of the elastic band. The pouch has an interior area. The pouch is formed of a soft pliable fabric. The pouch extends downwardly from the lower end of the elastic band.

The trousers-engaging means is in the nature of a strip of polymeric material. The strip of polymeric material is received within the pouch. This strip of polymeric material includes a vertical portion and a horizontal portion which define as a generally L-shaped cross section. The horizontal portion will engage with an interior surface of the trousers. In particular, the horizontal portion can engage with a seam located at the waist of the trousers in the area generally adjacent to the belt loops.

In particular, the horizontal portion of the strip includes a plurality of teeth that reside in spaced relationship to each other. A cut-out area is located on the plastic strip so as to correspond to the zipper and/or fastener of the trousers. The plastic strip will wrap around the waist of the wearer. The plastic strip is slidably received in the interior of the pouch.

In normal use, the elastic band is positioned around the abdomen and/or stomach of the wearer. As such, it provides an effective girdle-type effect. The pouch extends downwardly therefrom. The pouch will be received within the pants once the pants are applied thereover. As a result, the L-shaped cross-section of the plastic strip will have a horizontal portion which extends outwardly away from the body of the wearer so as to engage with a seam or a structure on the interior of the pants so as to effectively support the pants at a desired position at the waist. In other circumstances, a belt may be applied through the belt loops of the lower garment so as to reside against the vertical portion of the plastic strip. As a result of this configuration, a person will have an attractive appearance because the stomach is pulled-in. Also, the configuration of the present invention effectively suspends the trousers without the need for suspenders or belts. Also, through the configuration of the present invention, the lower garment will have a neat tucked-in appearance with respect to the lower garment. The wearer can go through a variety of daily activities without the dislodgement of the lower portion of the upper garment from the upper portion of the lower garment. As such, this neat appearance will continue throughout the day.

This foregoing Section is intended to describe, with particularity, the preferred embodiment of the present invention. It is understood that modifications to this preferred embodiment can be made within the scope of the present invention. As such, this section should not be construed, in any way, as limiting of the broad scope of the present invention. The present invention should only be limited by the following claims and their legal equivalents.

DETAILED DESCRIPTION OF THE INVENTION

Figure 1:
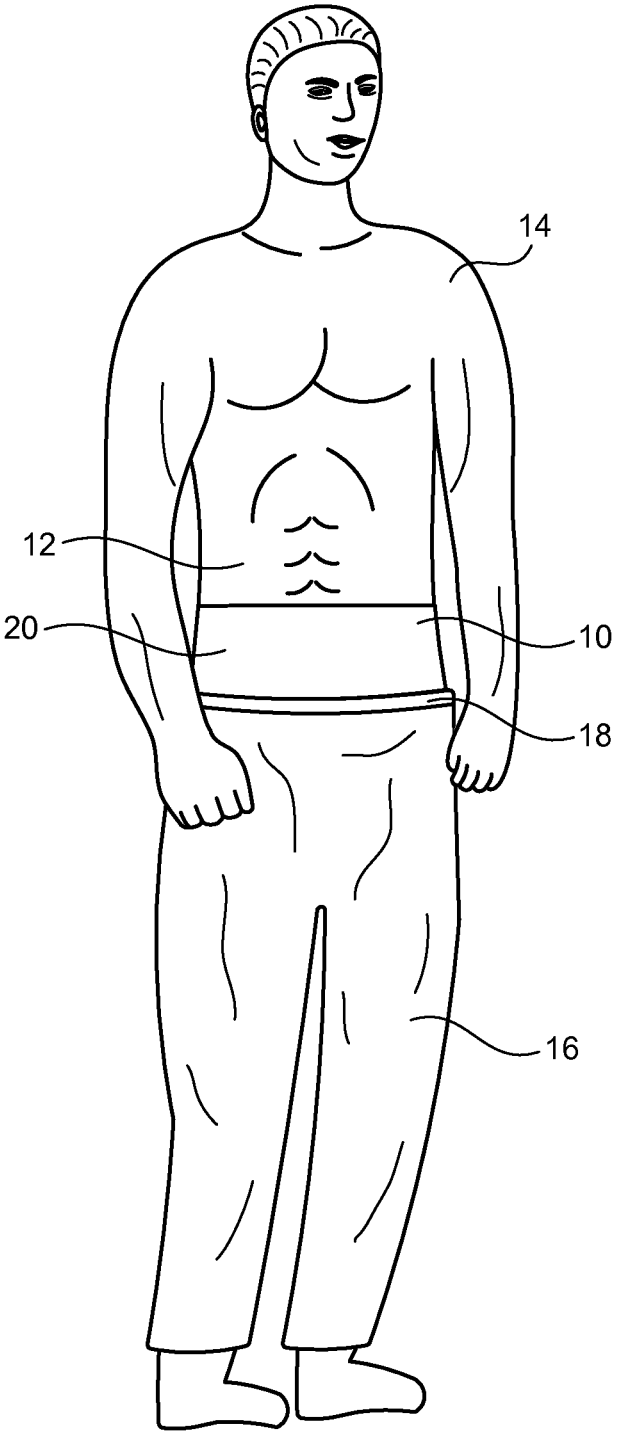
FIG. 1 is an illustration showing the application of the trousers supporting waist belt of the present invention upon a human body.

Referring to FIG. 1, there is shown the trousers supporting waist belt 10 in accordance with the teachings of the present invention. The trousers supporting waist belt 10 is illustrated as positioned on the abdomen 12 of a wearer 14. Additionally, the wearer 14 is illustrated as having trousers 16 positioned over the wearer's legs and lower abdomen. The trousers 16 include a belt area 18 at the upper end thereof. As will be described hereinafter, the trousers supporting waist belt 10 will include a suitable trousers-engaging means which will grasp an interior surface of the trousers 16 at the upper end thereof in the area of the belt area 18. As such, the trousers 16 will be supported at a desired location on the hips of the wearer 10. In the meantime, the trousers supporting waist belt 10 has an elastic band 20 which serves as a girdle-type article of clothing over the abdomen 12. As such, this elastic band 20 will compress the abdomen 12 so as to provide a neat and trim appearance to the wearer.

Figure 2:
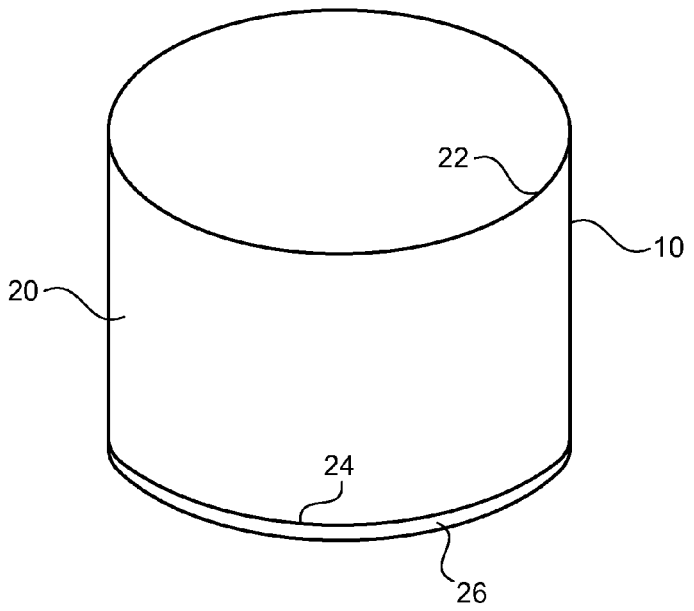
FIG. 2 is a perspective view showing the trousers-supporting waist belt of the present invention.

FIG. 2 is an isolated view showing the trousers supporting waist belt 10 of the present invention. As can be seen, there is an upper elastic band 20 which has an upper end 22 and a lower end 24. The elastic band 20 can be made of a suitable fabric, polymeric material, elastomeric material, or other elastic fabric. The elastic band 20 can have a circular or oval configuration.

In FIG. 2, it can be seen that there is a pouch 26 that extends downwardly from the lower end 24 of the elastic band 10. Pouch 26 has an interior area. Pouch 26 is formed of a soft pliable fabric material. In particular, the pouch 26 will serve to receive a plastic strip on the interior thereof. The pouch 26 can have a slot formed therein so as to allow the plastic strip to be threaded therethrough and introduced therein.

Figure 3:
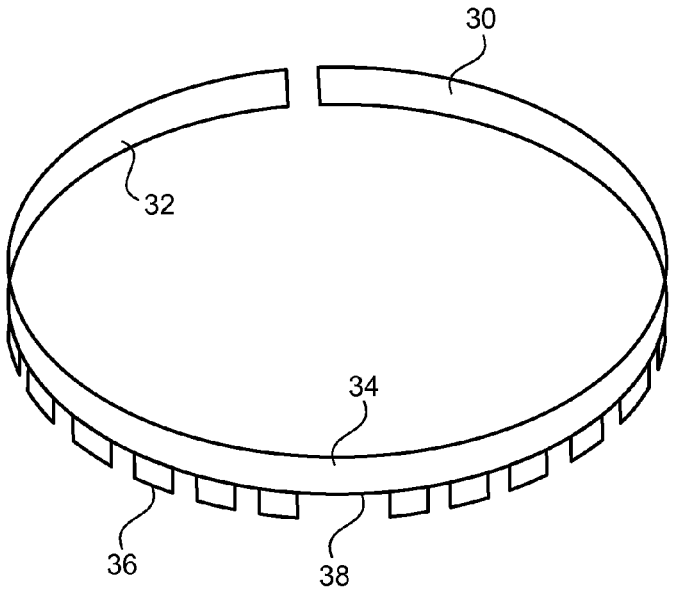
FIG. 3 is a upper perspective view showing the plastic strip as received within the pouch of the trousers supporting waist belt of the present invention.

FIG. 3 illustrates the plastic strip 30 that is received within the pouch 26. The plastic strip 30 is formed of a flexible plastic material. In particular, the plastic strip 30 includes a band 32 that extends in a generally circular configuration. The band 32 has a vertical portion 34 and a horizontal portion 36. The horizontal portion 36 is formed of teeth that are arranged in spaced-apart relationship. A cut-out area 38 is formed in the horizontal portion 36. The cut-out area 38 will correspond to the fasteners and/or zippers of the trousers. As such, the horizontal portion and the teeth associated with the horizontal portion 36 will not interfere with the opening or closing of the zipper.

Importantly, the teeth 36 are configured so as to extend outwardly of the vertical portion 34. The horizontal portion 36 will extend outwardly away from the body of the wearer. As such, they provide a surface for grasping or abutting an interior surface of the trousers. It is important that the horizontal portion 36 be in the nature of spaced-apart teeth. If the horizontal portion 36 were solid instead of having spaced-apart, then the flexibility of the band 32 would be compromised. The spacing of the teeth facilitates the ability to conform the shape of the band 32 to the waist of the wearer.

Figure 4:
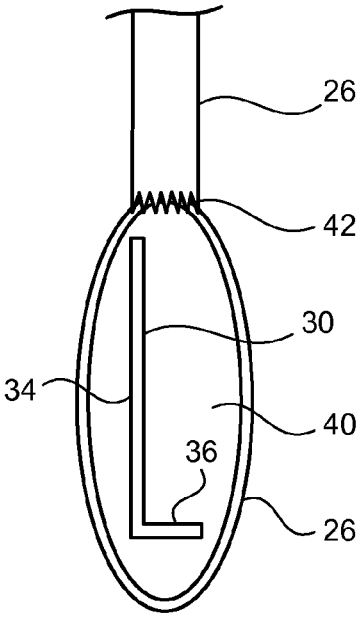
FIG. 4 is a cross-sectional view showing the location of the L-shaped plastic strip within the pouch of the trousers supporting waist belt of the present invention.

FIG. 4 illustrates how the plastic strip 30 is received within the interior area 40 of the pouch 26. In particular, it can be seen that the pouch 26 is secured to the lower end of the elastic band 20 through the use of threads 42. The plastic strip 30 is configured so that the vertical portion 34 will face in the direction of the body of the wearer. The horizontal portion 36 will extend away from the body of the wearer. The soft pliable fabric of the pouch 26 provides a comfortable surface for placement against the body of the wearer. This soft pliable material will not interfere, in any way, with the intended ability to secure the horizontal portion 36 with the interior surface of the trousers.

Figure 5:
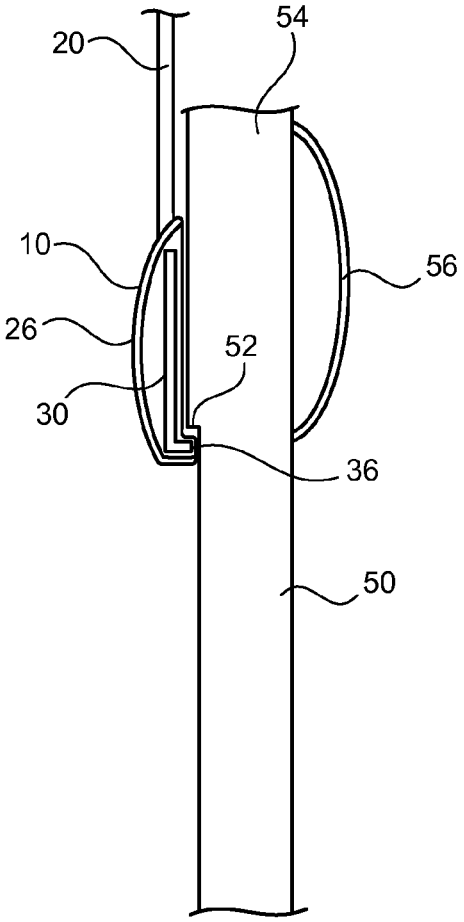
FIG. 5 is an illustration showing the application of the trousers supporting waist belt of the present invention upon the inner surface of trousers.

FIG. 5 shows the application of the trouser-supporting waist belt 10 of the present invention upon trousers 50. It can be seen that there is a small ledge 52 or seam located in the upper portion 54 of the trousers 50 generally adjacent to the belted area 56. The plastic strip 30 faces outwardly such that the horizontal portion 36 will abut this seam 52 so as to support the trousers in the desired position. The pouch 26 deforms so as to conform to the surfaces on the interior of the trousers 50. The elastic band 20 extends upwardly therefrom and is located within the interior of the trousers 50. As such, the trousers supporting waist belt 10 of the present invention will be concealed during use.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. An apparatus for supporting trousers, the apparatus comprising:

an elastic band adapted to wrap around a waist of a person wearing the trousers;

a pouch affixed to said elastic band, said pouch affixed at or adjacent to a bottom of said elastic band so as to extend downwardly therefrom, said pouch having an interior area, said pouch being formed of a soft pliable material; and a trousers engager adapted to grasp or abut an interior surface of the trousers, said trousers engager comprising a strip of polymeric material, said strip being received in said interior of said pouch, said strip of polymeric material having a vertical portion and a horizontal portion defining an L-shaped cross-section.

2. The apparatus of claim 1, said elastic band having a circular or oval shape.

3. The apparatus of claim 1, said elastic band having a fastener thereon so as to be adapted for removable placement around the waist of the person wearing the trousers.

4. The apparatus of claim 3, the fastener selected from the group consisting of hook-and-loop material, buttons, zippers and snaps.

5. The apparatus of claim 1, said horizontal portion adapted to engage with the interior surface of the trousers.

6. The apparatus of claim 5, said horizontal portion having a plurality of teeth arranged in spaced relation to each other.

7. The apparatus of claim 5, said horizontal portion having a cut-out area adapted to generally correspond with zippers or fasteners of the trousers.

8. The apparatus of claim 1, said strip of polymeric material being slidably received in said pouch.

9. An apparatus comprising:

trousers having an interior seam or structure on an interior thereof adjacent to a top of the trousers;

an elastic band adapted to wrap around a waist of a person wearing the trousers;

a pouch affixed to the elastic band and extending downwardly therefrom; and a trousers engager adapted to grasp or abut the interior seam or structure of the trousers, said pouch affixed at or adjacent to a lower edge of said elastic band, said pouch residing within the interior of said trousers at the top of said trousers, trousers engager comprising a strip of polymeric material, said strip being received in said interior of said pouch, said strip of polymeric material having a vertical portion and a horizontal portion defining an L-shape cross-section, said horizontal portion engaging with the interior seam or structure on the interior of said trousers.

10. The apparatus of claim 9, said trousers having a fastened opening at a front thereof, said horizontal portion having a cut-out area generally corresponding in location with the fastened opening at said front of said trousers.

11. An apparatus for supporting trousers, the apparatus comprising:

an elastic band adapted to wrap around a waist of a person wearing the trousers;

a pouch affixed to said elastic band; and a strip of polymeric material received within an interior of said pouch, said strip of polymeric material having a vertical portion and a horizontal portion defining an L-shaped cross-section, said horizontal portion adapted to engage with an interior surface of the trousers.

* * * * *